US006400243B2

(12) United States Patent
Oyama et al.

(10) Patent No.: US 6,400,243 B2
(45) Date of Patent: Jun. 4, 2002

(54) CONTACT SHOE DEVICE FOR CIRCUIT BREAKER

(75) Inventors: Jun Oyama; Koji Asakawa; Naoshi Uchida, all of Saitama (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 09/775,807

(22) Filed: Feb. 5, 2001

(30) Foreign Application Priority Data

Feb. 7, 2000 (JP) ..... 2000-029064

(51) Int. Cl.[7] ..... H01H 67/02

(52) U.S. Cl. ..... 335/132; 218/22

(58) Field of Search ..... 335/78–80, 128, 335/124, 131–2, 202, 16, 147, 195; 218/22

(56) References Cited

U.S. PATENT DOCUMENTS 6,150,908 A * 11/2000 Asakawa et al. ..... 335/132
6,194,984 B1 * 2/2001 Kappel et al. ..... 335/132

* cited by examiner

*Primary Examiner*—Lincoln Donovan
(74) *Attorney, Agent, or Firm*—Kanesaka & Takeuchi

(57) ABSTRACT

A contact shoe device for a circuit breaker is formed of a case, at least one pair of fixed contact shoes disposed in the case, at least one movable contact shoe disposed in the case for bridging the pair of the fixed contact shoes, and at least one pair of contact springs cooperating with the movable contact shoe. The contact springs urge the movable contact shoe to the pair of the fixed contact shoes to close an electric path between the pair of the fixed contact shoes. The movable contact shoe is separated from the pair of the fixed contact shoes against the contact springs when the electric path is open.

6 Claims, 3 Drawing Sheets

CONTACT SHOE DEVICE FOR CIRCUIT BREAKER

BACKGROUND OF THE INVENTION AND RELATED ART STATEMENT

The present invention relates to a contact shoe device for a circuit breaker, such as a molded case circuit breaker or an earth leakage breaker, and especially, to a contact shoe device with bridging movable contact shoes.

FIG. 5 shows a vertical sectional view of a three-pole circuit breaker in the ON state, which includes a contact shoe device of this kind. In this figure, a pair of fixed and opposing contact shoes 2 and 3 extending in a longitudinal direction is arranged in each electric path space in a mold case 1, wherein the electric path spaces are partitioned by partition walls for different polarities. Fixed contact shoes 2 and 3 have a pair of fixed contacts 2*a* and 3*a*, respectively, attached to bottom end surfaces thereof, and the fixed contact shoe 2 includes a built-in power supply terminal 4. A thermal and electromagnetic overcurrent tripping device 5 is arranged on the fixed contact shoe 3, though its internal configuration is not shown. The fixed contact shoe 3 is connected to a load terminal 6 via the overcurrent tripping device 5.

In the ON state shown in FIG. 5, a movable contact shoe 7 bridges the fixed contact shoes 2 and 3, and movable contacts 7*a* at opposite ends contact the fixed contacts 2*a* and 3*a*, respectively. The movable contact shoe 7 is guided and held by a movable contact shoe holder 8 formed of an insulating material, so as to slide vertically as shown in FIG. 5, while the movable contact shoe holder 8 is guided in the mold case 1 so as to slide vertically as shown in FIG. 5. The movable contact shoe 7 is urged against the fixed contact shoes 2 and 3 by a contact spring 9 formed of a compression coil spring and inserted between the movable contact shoe 7 and the bottom of the mold case 1 to apply predetermined contact pressure between the fixed and movable contacts. Arc-extinguishing chambers 10 formed of multiple arc-extinguishing grids laminated via gaps are arranged at front and rear sides of the movable contact shoe 7. The movable contact shoe holder 8, which holds the movable contact shoe 7, is opened and closed by a switching lever 11 located in the central polarity section. The switching lever 11 is supported on the mold case 1 so as to rotate around a switching shaft 12, and is opened and closed by a switching mechanism 13.

In such a circuit breaker, current flows from the power supply terminal 4 through the fixed contact shoe 2, movable contact shoe 7, fixed contact shoe 3, and overcurrent tripping device 5 to the load terminal 6, in this order. Then, when the operation handle 14 of the switching mechanism 13 is turned to become the OFF state, the switching lever 11 is rotated clockwise as shown in FIG. 5 to push the movable contact shoe holder 8 down against the contact spring 9. Thus, the movable contact shoe 7 is separated from the fixed contact shoes 2 and 3 to open the electric path.

In addition, when high current, such as short-circuit current, flows through the circuit breaker, the movable contact shoe 7 is driven downward in FIG. 5 by electromagnetic repulsion effected by contact between the fixed contacts 2*a* and 3*a* and the movable contact 7*a*, and by electromagnetic repulsion between the conductors of the fixed contact shoes 2 and 3 and the conductor of the movable contact shoe 7, which are arranged in parallel. The movable contact shoe 7 is thus quickly separated from the fixed contact shoes 2 and 3 as indicated by the dotted line. The overcurrent tripping device 5 is then actuated to operate the switching mechanism 13, which rotationally and rapidly drives the switching lever 11 clockwise due to energy stored in a switching spring (not shown). Consequently, the movable contact shoe 7 is held at a separated position via the movable contact shoe holder 8. At this point, arc 15 is generated between the fixed contacts 2*a* and 3*a* and the movable contact 7*a*, and expands as the movable contact shoe 7 is separated. The arc is finally drawn into the arc-extinguishing chamber 10 and extinguishes.

In the conventional circuit breaker shown in FIG. 5, the contact spring 9 is compressed when the movable contact shoe 7 is separated, so that as the separation of the movable contact shoe 7 proceeds, reaction force from the contact spring 9 increases to gradually reduce the separation speed of the movable contact shoe 7. To minimize the decrease in the separation speed, the number of windings in the contact spring 9 must be increased to reduce its spring constant. In this case, however, the contact spring 9 becomes longer correspondingly. However, when the contact spring is elongated, the interval between the movable contact shoe 7 and the bottom of the mold case 1 must be increased. As a result, the mold case 1 becomes higher, which hinders the size reduction of the circuit breaker.

The present invention solves these problems, and an object of the invention is to provide a circuit breaker which can reduce spring constant of a contact spring while preventing an increase in size of a mold case associated with contact spring installation.

Another object of the invention is to provide a circuit breaker as stated above, which can increase separation speed of the movable contact shoe without hindering the size reduction of the circuit breaker.

Further objects and advantages of the invention will be apparent from the following description of the invention.

SUMMARY OF THE INVENTION

To achieve the objective, the present invention according to the first aspect provides a contact shoe device for a circuit breaker, which comprises pairs of fixed contact shoes, with each pair opposing to each other and having a different polarity, and movable contact shoes, each bridging the fixed contact shoes. The movable contact shoe is pressed against the fixed contact shoes by contact springs inserted between the movable contact shoe and a mold case to close the electric path for each polarity, while the movable contact shoe is separated from the fixed contact shoes against the contact spring when the electric path is open. The contact spring is formed of a compression coil spring, and two contact springs are provided for each of the movable contact shoes.

When the number of windings in the contact spring formed of the compression coil spring increases to reduce the spring constant and reaction force applied by the contact spring when the movable contact shoe is separated, the contact spring becomes longer than that in conventional models. This requires that the spring contracting distance is increased to apply the same contact pressure as in the prior art while the circuit is closed. Thus, in the conventional configuration where the contact spring is inserted between the bottom surface of the movable contact shoe and the mold case, when an attempt is made to insert a long contact spring in a condition that an insertion space is unchanged, adjacent windings come to contact each other, and inhibit separation of the movable contact shoe from the fixed contact shoes over the required distance.

Thus, in the first aspect, each movable contact shoe has two contact springs, each of which is formed of a compression coil spring to evenly distribute the load on the movable contact, i.e. half the load when using a single contact spring. This reduces the wire diameter of each contact spring and increases the distance of spring contraction before the windings come into contact with each other, thereby enabling separation of the movable contact shoe over the required distance without significantly increasing the insertion space for contact springs, and regardless of the increase in the number of windings to reduce the spring constant.

In addition, according to the present invention in the second aspect, the contact springs are arranged on opposite sides of the movable contact shoe, and a spring holder is interposed between the movable contact shoe and contact springs. The upper ends of the contact springs extend above the movable contact shoe. Consequently, as compared to the insertion of the contact spring between the bottom surface of the movable contact shoe and the mold case, the insertion space for the contact spring can be more easily enlarged even at the same mold case height.

Conversely, in a third aspect, each of the contact springs may be formed of a torsion spring. Since the torsion spring has a constant height despite the increase in the number of windings, the spring constant of the contact spring can be reduced without increasing the height of the mold case.

DETAILED DESCRIPTION OF PREFERRED EMBODIMENTS

Figure 1:
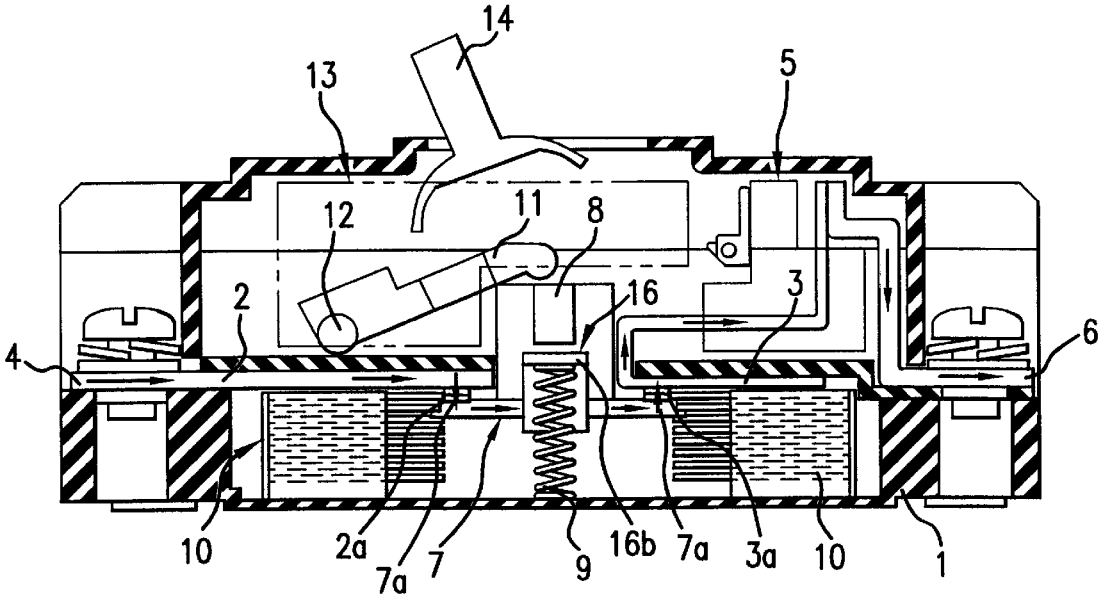
FIG. 1 shows a vertical sectional view of a circuit breaker according to an embodiment of the present invention.
Figure 2:
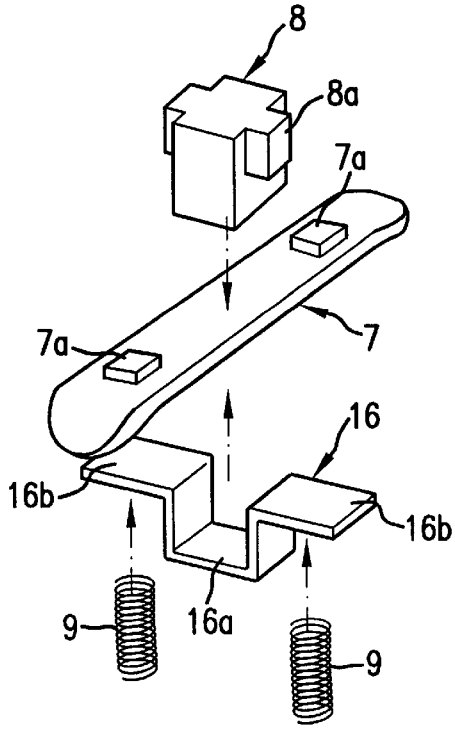
FIG. 2 shows an exploded perspective view of a movable contact shoe section of the circuit breaker shown in FIG. 1.
Figure 3:
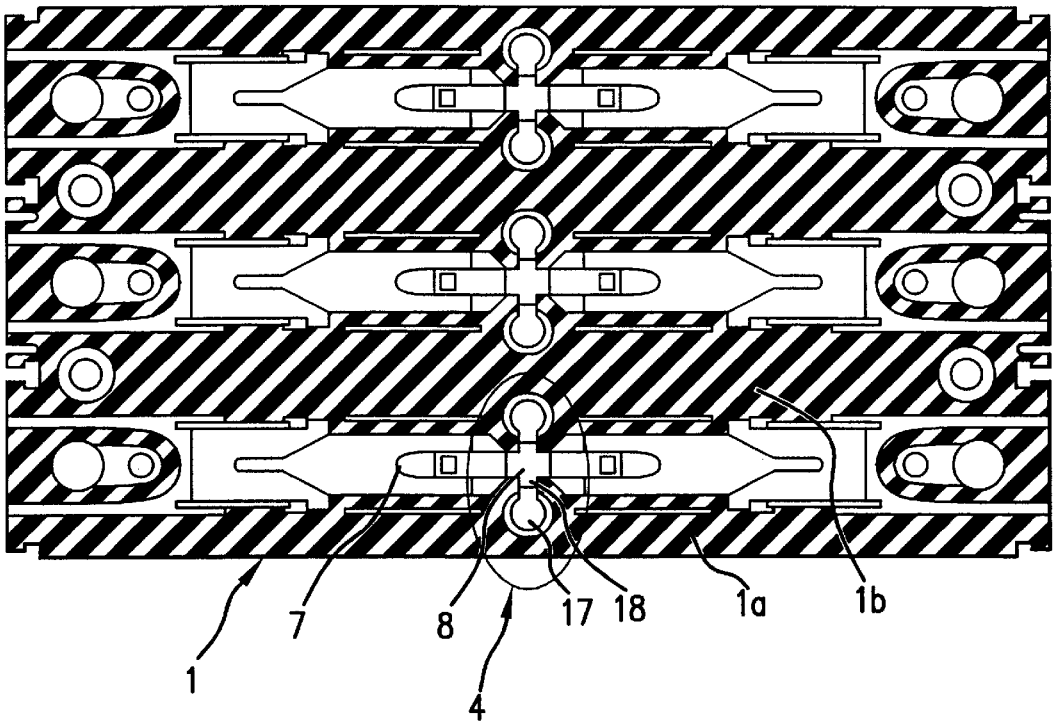
FIG. 3 shows a plan view of the mold case shown in FIG. 1.
Figure 4:
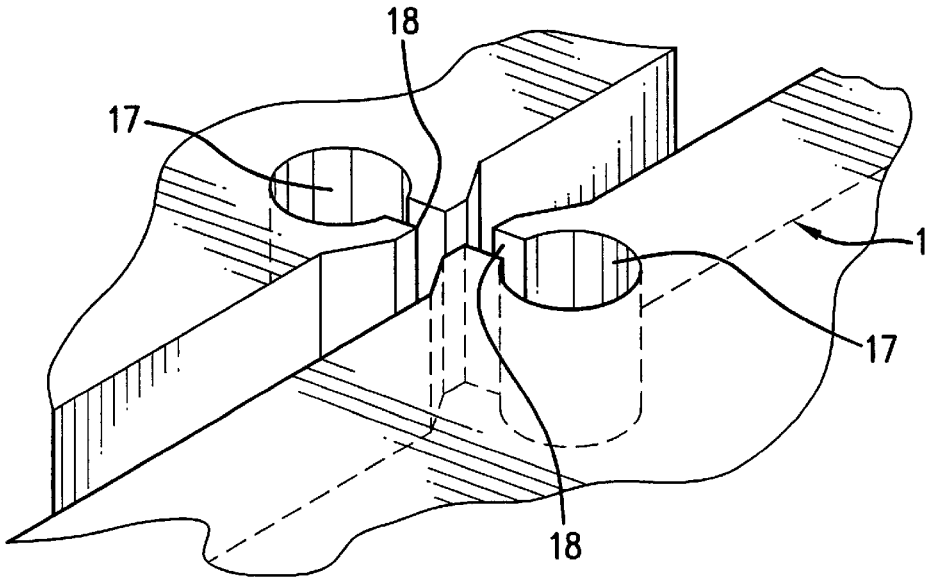
FIG. 4 shows an enlarged perspective view of a portion 4 shown in FIG. 3.
Figure 5:
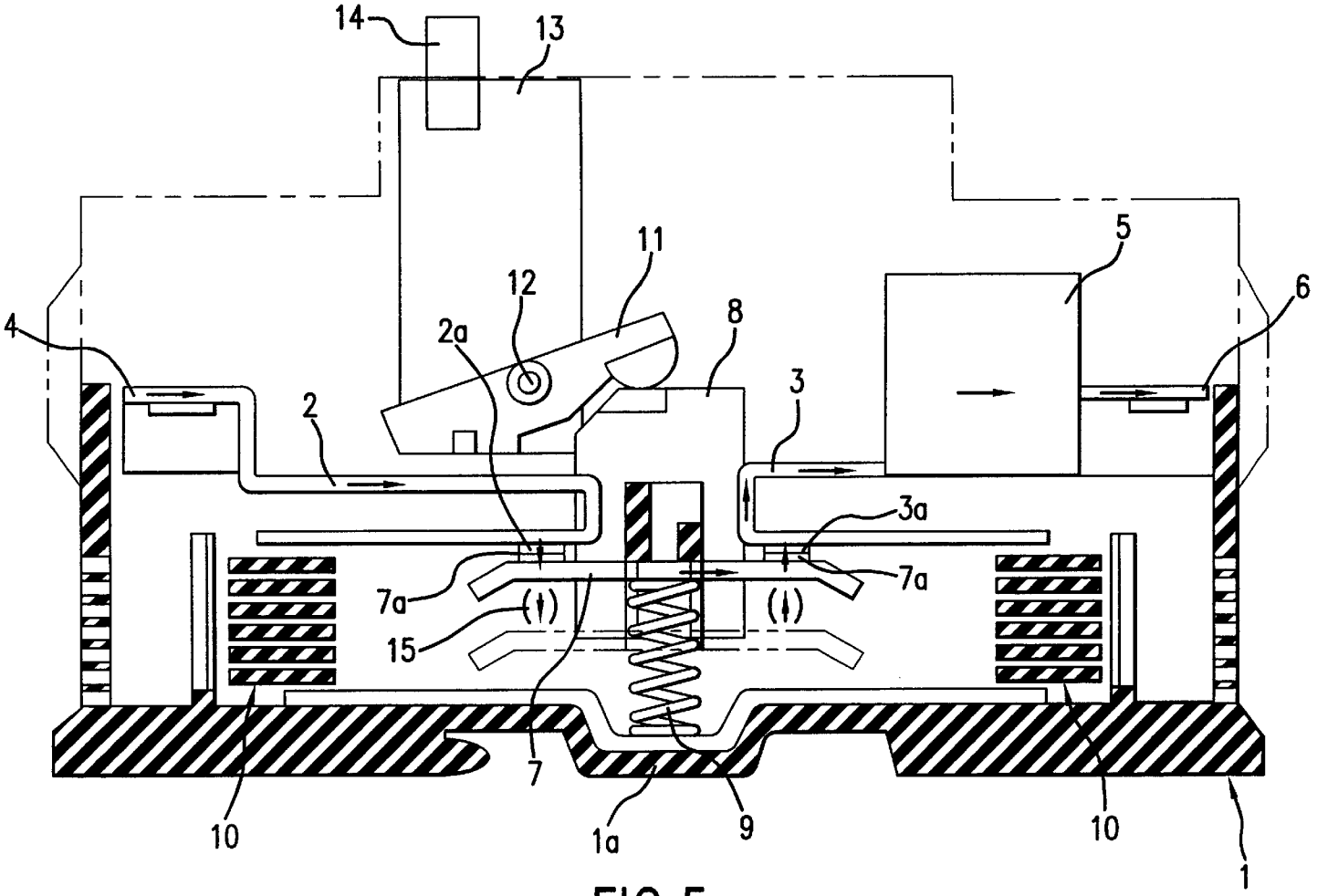
FIG.5 PRIOR ART
FIG. 5 shows a vertical sectional view of a conventional circuit breaker.

Embodiments of the present invention will be described below with reference to FIGS. 1 to 4. FIG. 1 shows a vertical sectional view of a circuit breaker with a closed circuit. FIG. 2 shows an exploded perspective view of a movable contact shoe section of the circuit breaker shown in FIG. 1. FIG. 3 shows a plan view of the mold case shown in FIG. 1. FIG. 4 shows an enlarged perspective view of a portion 4 shown in FIG. 3. Parts corresponding to the conventional example are denoted by the same reference numbers, and the descriptions of similar components are omitted.

The embodiment differs from the conventional example in that each movable contact shoe 7 has two compression coil springs or contact springs 9 arranged on opposite sides of the movable contact shoe 7. A spring holder 16 is interposed between the movable contact shoe 7 and the contact springs 9, and the upper ends of the contact springs extend above the movable contact shoe 7.

As shown in FIG. 2, a spring holder 16 is formed by pressing a steel plate into a Ω-shape, with the movable contact shoe 7 combined with a central recess 16*a* therein. The spring holder 16 contacts the top surfaces of contact springs 9 at the bottom surfaces of lateral arm sections 16*b*. On the other hand, as shown in FIGS. 3 and 4, the mold case 1 has cylindrical spring-receiving recesses 17 with bottoms, which are formed in side walls 1*a* and partition walls 1*b* thereof to receive the lower ends of the contact springs 9, and the arm sections 16*b* of the spring holder 16 extend to cover the spring-receiving recesses 17 from above. A side wall of each spring-receiving recess 17 is cut out vertically so that laterally opposite portions form a guide section 18 through which the corresponding lateral projection 8*a* (FIG. 2) of the movable contact shoe holder 8 slides.

The circuit breaker shown in FIG. 1 operates in the same manner as in the conventional example. In the ON state shown in the figure, when the operation handle 14 of the switching mechanism 13 is turned to change to the OFF state, the switching lever 11 is rotated to push the movable contact shoe holder 8 down against the contact springs 9. Thus, the movable contact shoe 7 is separated from the fixed contact shoes 2 and 3. In addition, when high current, such as short-circuit current, flows through the circuit breaker, the movable contact shoe 7 is driven downward as shown in FIG. 1 by electromagnetic repulsion and separated rapidly from the fixed contact shoes 2 and 3. The overcurrent tripping device 5 is then actuated to unlock the switching mechanism 13, which in turn rotationally and rapidly drives the switching lever 11 clockwise due to energy stored in a closing spring (not shown). Consequently, the movable contact shoe 7 is held in a separated position via the movable contact shoe holder 8.

In such a circuit breaker, the contact springs 9 are arranged on the corresponding sides of the movable contact shoe 7, and each spring has a smaller wire diameter than that of the conventional springs, as well as a large number of windings to minimize the spring constant. Accordingly, the contact springs 9 are longer than those in the conventional models and the gaps of the coil portions are greater in the illustrated ON state. The small wire diameter, however, serves to provide larger gaps between the adjacent coil portions, and the installation of the spring holder 16 serves to set the upper ends of the contact springs higher than the movable contact shoe 7 by an amount corresponding to the height of the arms 16*b*. This enables the sufficient space to insert the contact spring 9 between the bottom mold case 1 and the spring holder 16 without increasing the height of the mold case 1. In the illustrated example, the contact spring is formed of a coil spring, but a torsion spring also serves to reduce the spring constant without affecting the height of the mold case because the height of the contact spring remains unchanged despite the increase in the number of windings.

As described above, according to the present invention, contact springs with a reduced spring constant can be inserted without increasing the height of the mold case, which would otherwise hinder the reaction force from the contact springs when the movable contact shoe is separated and increase the separation speed of the movable contact shoe without enlarging the size of the circuit breaker. Thus, this circuit-breaking performance is enhanced.

What is claimed is:

1. A contact shoe device for a circuit breaker comprising:

a case, at least one pair of fixed contact shoes disposed in the case, at least one movable contact shoe disposed in the case for bridging the at least one pair of the fixed contact shoes, at least one pair of contact springs cooperating with the at least one movable contact shoe to urge the at least one movable contact shoe to the at least one pair of the fixed contact shoes to close an electric path between the at least one pair of the fixed contact shoes, said at least one movable contact shoe being separated from the at least one pair of the fixed contact shoes against the at least one pair of the contact springs when the electric path is open, said at least one pair of the contact springs being arranged on two sides of the at least one movable contact shoe so that upper ends of the at least one pair of the contact springs extend above the at least one movable contact shoe, and at least one spring holder interposed between the at least one movable contact shoe and the at least one pair of the contact springs.

2. A contact shoe device for a circuit breaker according to claim 1, wherein said spring holder extends perpendicular to a longitudinal direction of the at least one movable contact shoe, and has two lateral arm sections and a central recess between the arm sections, said central recess being located lower than the arm sections and contacting the at least one movable contact shoe.

3. A contact shoe device for a circuit breaker according to claim 2, further comprising at least one contact shoe holder disposed on the at least one movable contact shoe, said central recess being located under the at least one movable contact shoe.

4. A contact shoe device for a circuit breaker according to claim 1, wherein said at least one pair of the contact springs are formed of compression coil springs and are inserted between the at least one movable contact shoe and the case.

5. A contact shoe device for a circuit breaker according to claim 1, wherein a plurality of the fixed and movable contact shoes is arranged side by side in the casing.

6. A contact shoe device for a circuit breaker comprising:

pairs of fixed contact shoes for different polarities arranged side by side, each one pair of the fixed contact shoes being arranged in a longitudinal direction and opposing to each other, movable contact shoes for bridging the respective pairs of the fixed contact shoes, and pairs of torsion springs for urging the respective movable contact shoes against the pairs of the fixed contact shoes, each pair of the torsion springs being inserted between each of the movable contact shoes and a case to close an electric path for each polarity, each of said movable contact shoes being separated from each pair of the fixed contact shoes against each pair of the torsion springs when the electric path is open, said torsion springs forming each pair being arranged on two sides of each of the movable contact shoes so that upper ends of the torsion springs forming each pair extend above each of the movable contact shoes, and spring holders, each of said spring holders being interposed between each of the movable contact shoes and the torsion springs forming each pair.

* * * * *